United States Patent [19]

Winkler

[11] 4,042,199

[45] Aug. 16, 1977

[54] MOLDED FURNITURE LEG

[76] Inventor: Clifford Wilbur Winkler, Rte. 2, Box 561, Houghton Lake, Mich. 48629

[21] Appl. No.: 642,251

[22] Filed: Dec. 19, 1975

[51] Int. Cl.[2] ..... B60B 33/02; F16B 12/00

[52] U.S. Cl. ..... 248/188.8; 5/310

[58] Field of Search ..... 248/188.4, 188.8, 188.9; 5/310; 108/156

[56] References Cited

U.S. PATENT DOCUMENTS

| | | | |
|---|---|---|---|
| 2,823,392 | 2/1958 | Barry | 5/310 |
| 2,836,925 | 6/1958 | Reed | 248/188.4 |
| 3,104,493 | 9/1963 | Nalle | 248/188.4 |
| 3,338,190 | 8/1967 | Hammond | 108/156 |
| 3,697,147 | 10/1972 | Schulte | 248/188.4 X |
| 3,869,105 | 3/1975 | Daniels | 248/188.8 |

FOREIGN PATENT DOCUMENTS

| | | | |
|---|---|---|---|
| 659,442 | 11/1964 | Italy | 248/188.4 |
| 1,391,965 | 4/1975 | United Kingdom | 248/188.8 |
| 1,384,047 | 2/1975 | United Kingdom | 248/188.8 |

*Primary Examiner*—J. Franklin Foss

*Attorney, Agent, or Firm*—Pierce, Scheffler & Parker

[57] ABSTRACT

A hollow furniture leg molded from a thermosetting synthetic plastic is comprised of a central hollow core, an outer wall having an inverted frusto-conical configuration and a plurality of equally spaced reinforcing ribs interconnecting the core and outer wall. The internal diameter of the upper part of the core is sized to provide a driving fit for anchoring a stud by which the leg is fastened to the furniture and the internal diameter at the lower part of the core is sized to provide a driving fit through the closed bottom wall of the leg for the nail shank of a bottom furniture glide.

2 Claims, 4 Drawing Figures

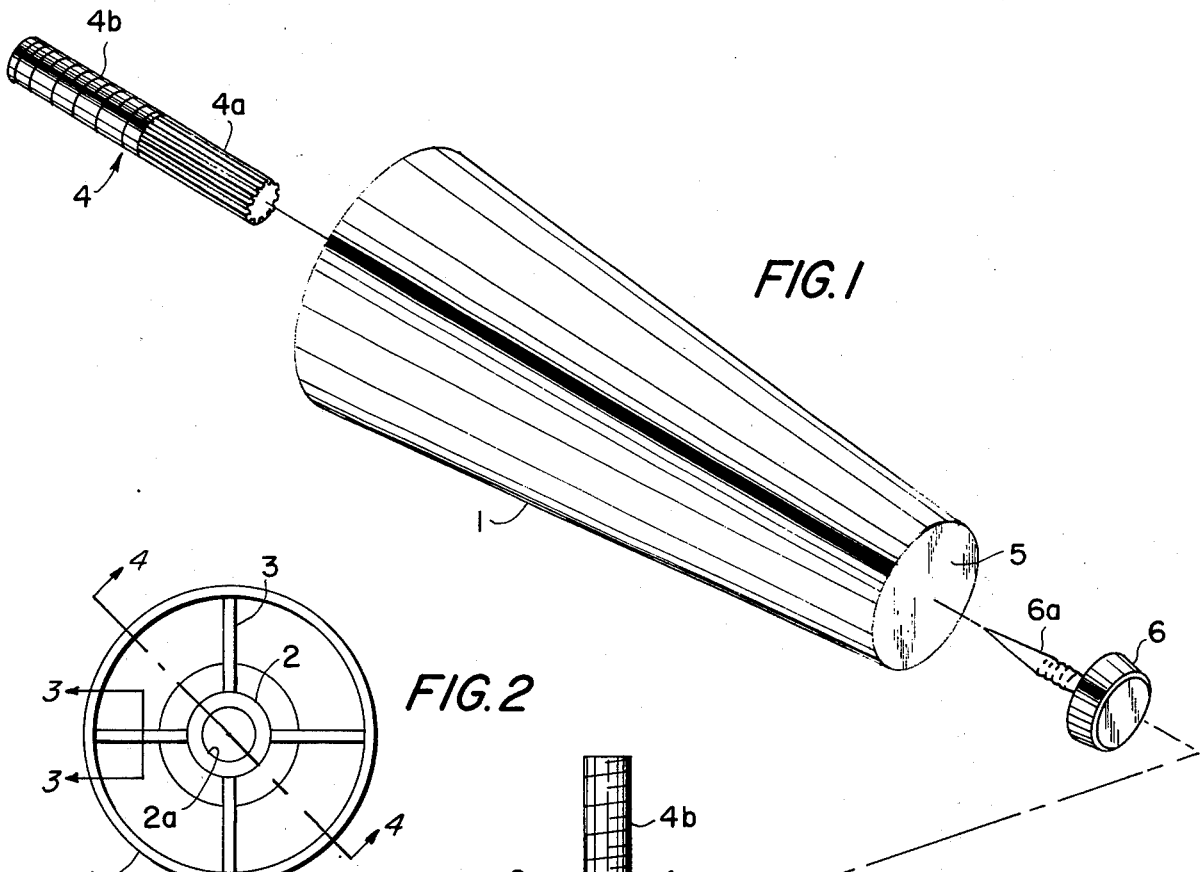
FIG. 1
FIG. 2
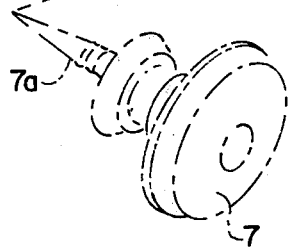
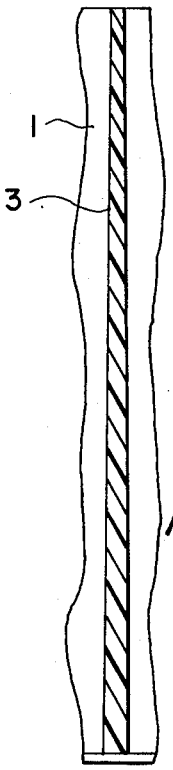
FIG. 3
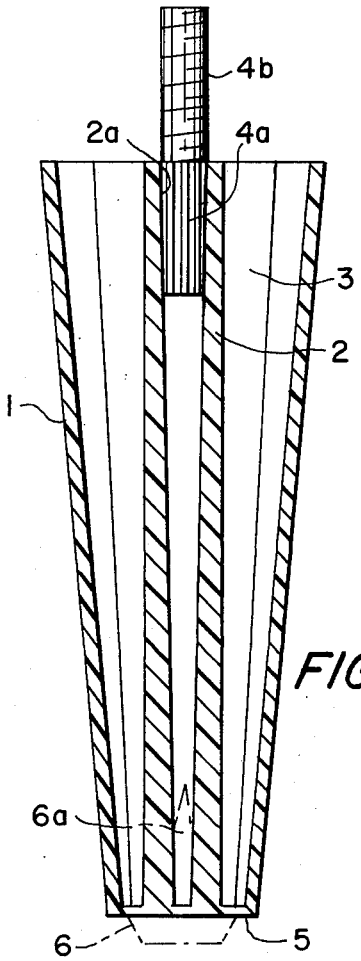
FIG. 4

MOLDED FURNITURE LEG

BACKGROUND OF THE INVENTION

Field of the Invention

This invention relates to an improvement in the construction of a furniture leg which is adapted to be secured in place at the underside of various types of furniture such as upholstered chairs, sofas, cabinets, bedding frames and the like.

SUMMARY OF THE INVENTION

The improved leg structure, which is produced by conventional injection molding technique using a thermosetting synthetic plastic such as a high impact polystyrene or acyrilonitrile butidene styrene is essentially a hollow body featuring a central, longitudinally extending core and a plurality of laterally extending ribs which terminate in the outer wall of the leg which may have any desired profile such as frusto-conical, cylindrical or polygonal, e.g. hexagonal or square. The central core, which preferably is also hollow, in conjunction with the overall hollow character of the leg provides a reinforced structure which is exceptionally strong in relation to its mass and requires only a minimal amount of material for its manufacture and is therefore also most economical to produce.

Assuming the central core to be hollow, the internal diameter of the core at its upper end is sized to provide a driving fit for anchoring a stud by which the leg is fastened to the furniture, and the internal diameter at its lower end is sized to provide a driving fit through the closed bottom wall for the nail shank of a bottom furniture glide. The internal diameter of the core progressively decreases from the top down resulting in a corresponding increase in thickness of the core wall and the reinforcing ribs also progressively increase in thickness from the top down.

BRIEF DESCRIPTION OF THE DRAWINGS

A preferred construction for a furniture leg in accordance with the invention is illustrated in the accompanying drawings wherein:

FIG. 1 is an exploded view of the three component parts of the furniture leg, these being the molded body, the attachment stud at the upper end and the glide at the lower end;

FIG. 2 is a top plan view of the leg;

FIG. 3 is a vertical sectional view of one of the reinforcing ribs taken on line 3—3 of FIG. 2; and FIG. 4 is a vertical diametral section of the leg taken on line 4—4 of FIG. 2.

DESCRIPTION OF THE PREFERRED EMBODIMENT

With reference now to the drawings, the furniture leg constructed in accordance with the invention has an inverted tapered configuration, i.e. a frustoconical outer wall 1 and is produced by conventional injection molding technique using a thermosetting plastic such as a high impact polystyrene, or acyrilonitride butidene styrene. The leg includes a longitudinally extending central hollow cylindrical core 2 provided with equally spaced radially extending ribs 3 which terminate in the outer wall 1. In the illustrated embodiment, four such ribs are provided and are spaced 90° apart relative to the longitudinal axis of the leg.

Since in view of the frusto-conical configuration of the leg, the reinforcing ribs 3 decrease in width from top to bottom they preferably progressively increase in thickness from top to bottom as depicted in FIG. 3.

The internal diameter of the cylindrical core 2 is not uniform throughout its length but rather progressively decreases in diameter from top to bottom thereby also resulting in a corresponding progressive increase in thickness of the core wall. The internal diameter of the core 2 at its upper end portion *2a*, is sized to provide an undersized, driving fit for the lower section *4a* of a stud 4 by which the leg is to be attached to the furniture. This lower section *4a* can be suitably profiled such as by the illustrated longitudinally extending knurling so as to anchor it securely in place within the plastic material. The upper section of stud 4 is threaded at *4b* for fastening into a furniture bracket in any conventional manner. The stud 4 can be driven into the hollow portion *2a* of core 2 by means of a so-called "sonic" welder. Using this method, the molded plastic under pressure is heated, flowing around the knurled part of the stud 4 thus making a permanent bond that prevents the stud from pulling out, or turning within the core.

The furniture leg in accordance with the invention may be used with various types of conventional leg fastener structures suitable or receiving the upper portion of stud 4. Various types are disclosed for example in U.S. Pat. Nos. 1,512,653; 1,928,469; 3,135,309; 3,207,022 and 3,263,630.

At the bottom of the leg the portion *2b* of the hollow core has a much smaller diameter which is sized to provide an undersized, driving fit through the closed bottom wall 5 for the nail shank of a bottom furniture glide if such a glide is desired. Two alternative glide structures are depicted in FIG. 1, namely a plain button type of glide with its head 6 and nail shank *6a*, and a more ornamental one with its head 7 and nail shank *7a*. The heads of the glides can be either metal or a plastic such as nylon.

I claim:

1. A molded hollow furniture leg comprising an outer wall having an inverted tapered configuration, a bottom wall, a centrally located hollow core extending from the top of said outer wall to said bottom wall, the internal opening through said hollow core progressively decreasing in size from the top down to provide for insertion of a stud in the upper end by which to attach the leg to furniture, a driving fit in the lower end for insertion of a nail shank of a furniture glide adjacent said bottom wall and a progressively increasing thickness of the core wall, and a plurality of equally spaced reinforcing ribs interconnecting said core and outer wall and which progressively increase in thickness from the top of said outer wall to said bottom wall.

2. A molded hollow furniture leg comprising an outer wall having an inverted frusto-conical configuration, a bottom wall, a centrally located hollow cylindrical core extending from the top of said outer wall to said bottom wall, the internal diameter of the opening through said hollow core progressively decreasing from the top down to provide for insertion of a stud in the upper end by which to attach the leg to furniture, a driving fit in the lower end for insertion of nail shank of a furniture glide adjacent said bottom wall and a progressively increasing thickness of the core wall, and a plurality of equally spaced reinforcing ribs interconnecting said core and outer wall and which progressively increase in thickness from the top of said outer wall to said bottom wall.

* * * * *